United States Patent [19]

Goetze et al.

[11] 4,125,924

[45] Nov. 21, 1978

[54] METHOD OF PRODUCING COMPOSITE METAL PIPE

[75] Inventors: Edward S. Goetze, Ross Township, Lake County, Ind.; Frank Kennedy, Mt. Lebanon Township, Allegheny County, Pa.

[73] Assignee: United States Steel Corporation, Pittsburgh, Pa.

[21] Appl. No.: 784,005

[22] Filed: Apr. 4, 1977

[51] Int. Cl.[2] ..... B21H 1/14; B21K 1/02; B23P 17/00; B23P 11/00

[52] U.S. Cl. ..... 29/148.4 D; 29/412; 29/417; 29/516; 29/520; 29/130; 138/140

[58] Field of Search ..... 29/516, 412, 520, 417, 29/148.4 D; 138/151, 140

[56] References Cited

U.S. PATENT DOCUMENTS

| | | | |
|---|---|---|---|
| 1,839,964 | 1/1932 | Harvey | 29/516 UX |
| 2,219,434 | 10/1940 | White | 29/516 UX |
| 3,461,523 | 8/1969 | Peehs et al. | 29/516 X |
| 3,863,328 | 2/1975 | Arntz | 29/516 |

*Primary Examiner*—Charlie T. Moon
*Attorney, Agent, or Firm*—Forest C. Sexton

[57] ABSTRACT

A composite metal pipe or tube is formed by cold sink drawing a first pipe to work-harden the walls thereof, and then telescoping a softer pipe thereover and cold sink drawing the telescoped combination to stretch and compress the outer pipe over the work-hardened inner pipe.

11 Claims, 2 Drawing Figures

METHOD OF PRODUCING COMPOSITE METAL PIPE

This invention relates generally to composite metal pipe, and more specifically to a method for producing composite pipe or tubing of dissimilar metals.

There are numerous prior art methods for producing composite double walled pipe of two dissimilar metals. Insofar as the production of relatively thick claddings is concerned, i.e. wherein each wall member is thicker than that obtained by conventional electrodeposition or flame spraying, such methods typically involve one of three basic techniques. These are: (1) weld-deposit overlays, (2) diffusion bonding of two separate telescoped pipes or tubes by various heat treatments and (3) drawing or rotary swaging of two separate telescoped pipes or tubes through one or more dies and over one or more mandrels. Each of these techniques, however, have their own characteristic disadvantages. For example, procedures for producing weld-metal overlays are time-consuming and the composite pipe or tube must be machined after welding to provide a smooth weld surface. Diffusion bonding, on the other hand, requires rather exacting overlay tolerances as well as extensive surface preparation and cleaning. In addition, good uniform bonding is not necessarily assured. Accordingly, the most simplified approach, and one that assures a good bond, is that of drawing or rotary swaging a pair of telescoped pipes or tubes through dies and over mandrels. Because a mandrel must be used with this technique, however, this method necessarily imposes a limit on the length of composite pipe that can be produced, and imposes a limit on the wall thickness that can be drawn or swaged. In addition, positioning the mandrel prior to commencing a draw thereover is a cumbersome procedure. Examples of such processes may be found in U.S. Pat. Nos. 3,863,328, Arntz; 3,509,617, Winter; 3,463,620, Winter; and 2,219,434, White.

The primary object of this invention is to provide a method for producing composite pipe or tubing of two different metals which utilizes only sink drawing techniques without the need for drawing over mandrels or the use of special heat treatments.

Another object of this invention is to provide a simple method for producing composite pipe or tubing of two different metals having an exceptionally good, strong, mechanical pressure bond between the two metal surfaces.

A further object of this invention is to provide a simple method of producing composite pipe or tubing which by virtue of the fact that a mandrel is not used, permits the production of longer pipe or tube sections and thicker wall members.

Still another object of this invention is to provide composite metal rollers for roller hearth annealing furnaces having a nickel outer surface to substantially prolong the life of such rollers.

Figure 1:
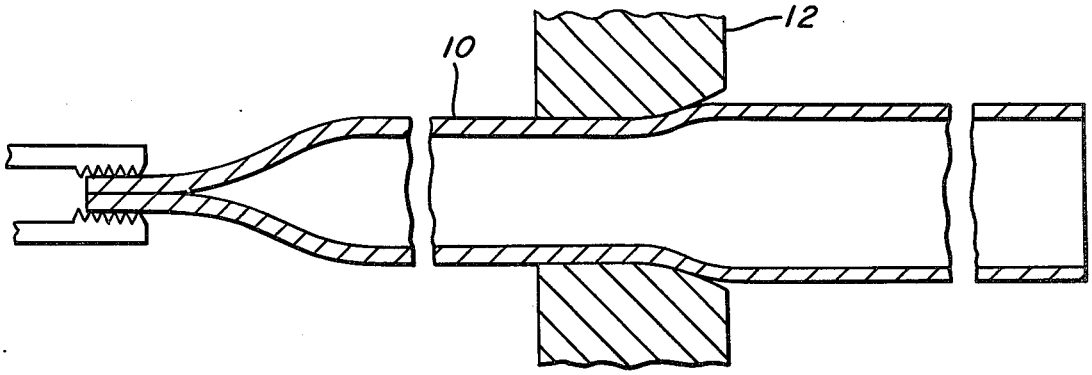
Figure 2:
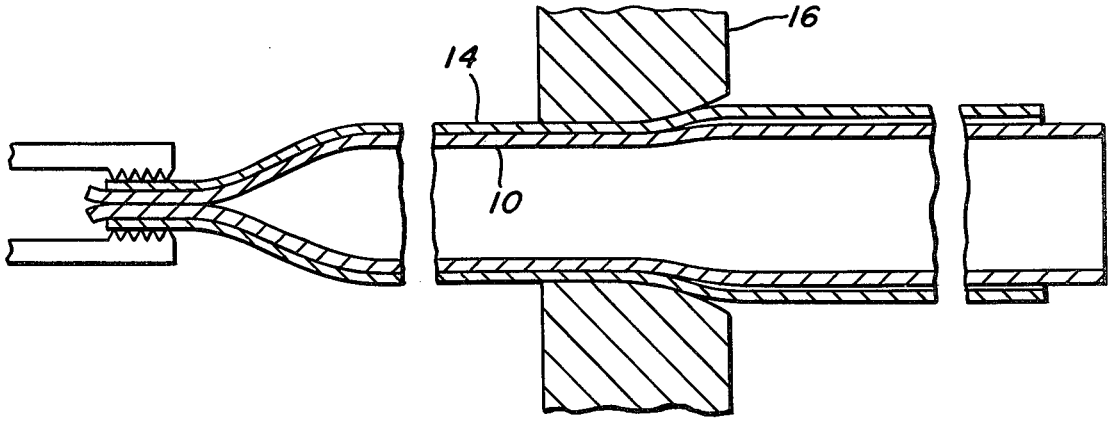

With reference to the drawings, FIGS. 1 and 2 illustrate the two basic steps of the inventive process disclosed herein, where:

FIG. 1 is a sectional view showing a sink draw of the inner pipe member which is made of a work-hardenable metal, and FIG. 2 is a sectional view showing the subsequent sink draw of the outer pipe member telescoped over the drawn inner pipe member.

Although it is recognized that there is a technical difference between pipe and tubing insofar as commercial dimensioning is concerned, as used hereinafter, "pipe" shall mean either pipe or tubing.

In essence, the basic concept of this inventive process involves telescoping two dissimilar work-hardenable metal pipes, and then sink drawing the two pipes, i.e. cold drawing the pipes through a die without drawing over a mandrel. Prior thereto however, the inner pipe is sink drawn to work harden the structure sufficiently so that it is harder than the outer pipe material prior to the final sink draw.

To more specifically illustrate one embodiment of this invention, it is of course first necessary that the two pipe materials be preselected. The two materials should be selected from metals which can be cold drawn and are subject to work-hardening when drawn through a die, such as steels, ferrous alloys, nickel, copper and brass. To be cold drawable on conventional commercial equipment, typically requires that the metal have a hardness of less than 95Rb (Rockwell b). The material chosen for the inside pipe component should be provided in pipe form with an outside diameter greater than that desired in the final product. With reference to the drawings, the end of this inner pipe 10 is pointed pursuant to conventional practices so that it can be drawn through a die 12. This inner pipe 10 is then cold sink drawn through die 12, preferably having a die angle of 15° or less, with a sufficient reduction in the outside diameter that the material is work-hardened sufficiently so that it is harder than the material selected for the outside pipe 14. As noted above, pipe 10 should have a hardness of less than 95Rb. After the draw however, pipe 10 hardness may exceed 95Rb. Since a mandrel is not used in this drawing operation, the pipe 10 is not only elongated by the sink draw, but also the pipe wall thickness may be increased somewhat, depending on the die angle of die 12.

After the inner pipe 10 has been cold sink drawn as shown in FIG. 1, it is telescoped into pipe 14, made of a work-hardenable material selected from the outside component. The outside diameter of pipe 10 and of pipe 14 must be sufficiently greater than that desired for the final product. One end of pipe 14 is pointed to overlay the pointed end of pipe 10 so that both pipes can be drawn simultaneously. Although clearance tolerances are not particularly critical, we have found the provision of about ⅛ to ¼ inch diameter difference between pipes 10 and 14 to be ideal for permitting easy assembly at least insofar as pipes of the 2 to 6 inch category are concerned. As shown in FIG. 2, the telescoped combination of pipes 10 and 14 are then cold sink drawn through die 16 to thin and stretch outer pipe 14 tightly over the work hardened inner pipe 10. This cold sink draw should be sufficient to reduce the outer pipe 14 wall weight per unit length by at least about 10%, but not more than 50%, and also to reduce the inner pipe 10 wall weight per unit length from about 3 to 5%. Although the drawing forces will compress and reduce the outside diameter of the inner pipe, its hardened condition causes it to rebound somewhat after the draw to greatly strengthen the bond at the interface and develop a good interference fit. In addition, the heat of friction imparted to the outer pipe 14 by the drawing operation increases the temperature thereof with respect to the inner pipe 10. This will subsequently cause an increase in its compressive forces when ambient temperatures are regained and further increase the interference fit. As a result, the mechanical bond between pipe 10 and 14 is considerably greater than could be achieved by other techniques.

With reference to the above described process, it is preferable that the drawing dies have a die angle of no more than about 15°, particularly for the first sink draw of the inner pipe 10, but in either event the die angle should not exceed 30°. Sink drawing a pipe of thin or moderate wall thickness will tend to increase pipe thickness if the die angle is 15° or less. Between 15° and 30° die angles, a pipe wall section is not thickened appreciably. With use of die angles greater than about 30°, however, the thickening process is offset by shearing forces which cause a thinning of the wall section and hence, the pipe may be excessively work-hardened.

As noted above, pipe 14 should be cold sink drawn onto pipe 10, as shown in FIG. 2, to an extent sufficient that the wall of pipe 14 is given a weight per unit length reduction of from about 10% to 50%. Reductions of less than about 10% may result in weaker bonding at the interface due to reduced interference fit forces. More than a 50% weight reduction could fracture pipe 14 if it does not exceed draw-bench capabilities. The 10 to 50% weight per unit length reduction in pipe 14 is controlled not only by the reduced outside diameter of pipe 14, i.e. as controlled by the diameter of die 16, but also by the clearance between the two telescoped pipes prior to the last draw through die 16. As noted above, sink drawing, i.e. drawing without a mandrel, will tend to increase the pipe wall thickness, at least with die angles of 15° or less. When drawing the telescoped pipes through die 16 however, inner pipe 10 must be of sufficient outside diameter and must be spaced sufficiently close to pipe 14 that it acts like a mandrel to thin the wall thickness of pipe 14 and to limit the reduction of the inside diameter to pipe 14. It is apparent therefore, that the clearance between pipes 10 and 14 when telescoped together prior to drawing through die 16 is important not only to facilitate the telescoped assembly, but also to assure that pipe 14 receives the 10–50% weight per unit length reduction and that pipe 10 is subjected to compressive forces and reduction of outside diameter of from about 3 to 5% (weight per unit length). In view of the variable thicknesses that can be employed for pipe 14, as well as various over all differences in sizes, it is not feasible to specify a given clearance limit. It should be sufficient to say that the clearance should be such that when considering the size of pipe 14 and die 16, a weight per unit length reduction of from about 10% to not more than 50% is effected. In order to provide a better understanding, it was stated above that insofar as working with pipe sizes in the range of 2 to 6 inches, diameter differences of from ⅛ to ¼ inch are preferred. However, somewhat larger clearances, to say ½ inch, would not be prohibitive. When working with substantially larger pipe sizes, proportionally larger clearances will be necessary to assure that sufficient weight reduction in pipe 14 is effected. Conversely, when working with signficantly smaller pipe sizes, the clearances will have to be scaled down proportionably to assure that pipe 14 is not excessively reduced.

To illustrate one specific application of this inventive process, it was desired to develop a simple method for providing a non-porous nickel coating onto stainless steel pipe, more specifically rollers for a roller hearth annealing furnace. The furnace was being used to continuous anneal cold drawn steel wire having some borax on the surface thereof. The borax was used as a dry lubricant during the preceding drawing operation, some of which remained on the surface during the subsequent annealing. The rollers in the furnace were made of stainless steel (20% Cr–25% Ni). The atmosphere in the furnace was normally oxidizing to stainless steel at the annealing temperature of 1750° F., and hence a thin chromium oxide film was formed on the rollers. At this annealing temperature however, the borax on the wire tended to flux the chromium oxide from the rollers so that tiny chromium oxide particles were picked up by the wire. The presence of these tiny particles caused excessive die wear during subsequent drawing operations. To prevent this chormium oxide fluxing, it was desired to provide a pure nickel coating on the furnace rollers. An initial trial providing a flame-sprayed nickel coating proved unsuccessful for extended operation as the coating was too porous to prevent gradual chromium oxidation. The sprayed coating was also susceptible to flaking and peeling. Eventually, the process as described herein was contemplated. To this end, the above described process was conceived and tested. For this test it was decided to utilize AISI Type 330 stainless steel for the inner pipe and nickel 200 for the outer pipe. The starting material for stainless steel inner pipe was a 2½ inch schedule 40 Type 330 pipe having a nominal wall thickness of 0.215 inches. As purchased, the pipe had a Rb hardness of 80. The starting material for the outside pipe was a 3 inch schedule 10 nickel 200 pipe having an actual outside diameter of 3.500 inches and wall thickness of 0.129 inch, with an Rb hardness of 54. The stainless steel pipe was then sink-drawn through a die having a die angle of 15°, reducing the outside diameter from 2.875 inches to 2.75 inches. This draw caused the wall thickness to increase from 0.215 inch to 0.218 inch and increased the Rb hardness to about 90. The nickel pipe was also sink drawn about 6.7% for the purpose of reducing the inside diameter somewhat so as to form a closer fit when the pipes were telescoped. The sink-draw affected an inside diameter reduction to 2.99 inches, from 3.242 inches which fit nicely over the 2.750 inches outside diameter of the stainless steel pipe. The two pipes were then telescoped and sink-drawn through a die having a die angle of 15° to an outside diameter of 2.874 inches. This draw thinned the nickel pipe wall to a thickness of 0.128 inch. In the final composite pipe, the inner stainless steel wall thickness measured 0.219 inch, with an inside diameter of 2.18 inches, and an outside diameter of 2.618 inches. The outer nickel pipe then had an inside diameter of 2.618 inches and an outside diameter of 2.874 inches. The Rb hardnesses of the two walls were 88 for the nickel and 93 for the stainless steel.

The above composite pipe was then cut into suitable lengths, and installed as rollers in the roller-hearth furnace. At the annealing temperature of 1750° F., the rollers served very well maintaining the good strong bond between the two wall members. After continuous operation at 1750° F., one test roller was removed from the furnace and cut into five pieces. The mechanical bond and interference fit at the interface was still extremely tight, and had not loosened during such high temperature service. Further use of the composite rollers over a period of many months has shown that the test rollers have not shown any noticeable degree of deterioration as contrasted to the original stainless steel rollers, and hence represent a significant improvement in roller-hearth furnace technology.

We claim:

1. A method for producing a composite metal pipe consisting essentially of selecting a first pipe member made of a drawable and work-hardneable metal, cold sink drawing said first pipe member through a first die having a die angle no greater than 30° to work-harden the microstructure thereof, selecting a second pipe member made of a work-hardenable metal having a hardness which is less than the hardness of the work-hardened first pipe member and having an inside diameter larger than the outside diameter of the work-hardened first pipe member, telescoping said second pipe member over said first pipe member, and cold sink drawing the telescoped pipe members through a second die having a die angle no greater than 30° to stretch and compress said second pipe member tightly over the first pipe member to form a composite pipe thereof such that the weight per unit length of said second pipe member is reduced at least about 10% but not more than 50% and the weight per unit length of said first pipe member is reduced from about 3 to 5%.

2. A method according to claim 1 in which said first and second pipe members have a hardness of less than 95Rb prior to any work-hardening.

3. A method according to claim 1 in which said first and second dies have die angles no greater than 15°.

4. A method according to claim 1 in which said first and second pipe members have diameters greater than about 2 inches but less than about 6 inches, and when telescoped prior to sink drawing the second pipe member, the inside diameter of said second pipe member is from about ⅛ to ¼ inch larger than the outside diameter of said first pipe member.

5. A method according to claim 1 in which said first pipe member is made of a ferrous alloy and said second pipe member is made of a non-ferrous metal.

6. A method according to claim 5 in which said first pipe member is made of a stainless steel and said second pipe member is made of commercially pure nickel.

7. A method for producing a composite metal roller for a roller hearth annealing furnace consisting essentially of selecting a first pipe member made of a stainless steel suitable for service at elevated temperatures, cold sink drawing said first pipe member through a first die having a die angle no greater than 30° to work-harden the microstructure thereof, selecting a second pipe member made essentially of nickel and having an inside diameter larger than the outside diameter of the work-hardened first pipe member, telescoping said second pipe member over said first pipe member, cold sink drawing the telescoped pipe members through a second die having a die angle no greater than 30° to stretch and compress said second pipe member tightly over the first pipe member to form a composite pipe thereof such that the weight per unit length of said second pipe member is reduced at least about 10% but not more than 50% and the weight per unit length of said first pipe member is reduced from about 3 to 5%, and cutting the composite pipe to the desired length for service as rollers.

8. A method according to claim 7 in which said first and second pipe members have a hardness of less than 95Rb prior to any work-hardening.

9. A method according to claim 7 in which said first and second dies have die angles of less than 15°.

10. A method according to claim 7 in which said first and second pipe members have diameters greater than about 2 inches but less than about 6 inches, and when telescoped prior to sink drawing the second pipe member, the inside diameter of said second pipe member is from about ⅛ to ¼ inch larger than the outside diameter of said first pipe member.

11. A method according to claim 7 in which said first pipe member is made of Type 330 stainless steel.

* * * * *